US009879450B2

(12) United States Patent
Wahmann et al.

(10) Patent No.: US 9,879,450 B2
(45) Date of Patent: Jan. 30, 2018

(54) LOCK FOR A MOTOR VEHICLE

(71) Applicant: Kiekert Aktiengesellschaft, Heiligenhaus (DE)

(72) Inventors: Hendrik Wahmann, Dusseldorf (DE); Dirk Eichel, Velbert (DE); Carsten Fuchs, Dusseldorf (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 280 days.

(21) Appl. No.: 14/772,438

(22) PCT Filed: Feb. 14, 2014

(86) PCT No.: PCT/DE2014/000055
§ 371 (c)(1),
(2) Date: Sep. 3, 2015

(87) PCT Pub. No.: WO2014/135139
PCT Pub. Date: Sep. 12, 2014

(65) Prior Publication Data

US 2016/0017643 A1 Jan. 21, 2016

(30) Foreign Application Priority Data

Mar. 6, 2013 (DE) ..... 10 2013 203 808

(51) Int. Cl.
*E05C 3/16* (2006.01)
*E05B 77/54* (2014.01)
(Continued)

(52) U.S. Cl.
CPC ..... *E05B 77/54* (2013.01); *E05B 77/06* (2013.01); *E05B 85/243* (2013.01); *E05C 3/12* (2013.01); *E05C 19/00* (2013.01); *E05C 19/02* (2013.01)

(58) Field of Classification Search
CPC ..... Y10T 292/1047; Y10T 292/1082; Y10T 292/0908; Y10T 292/1048;
(Continued)

(56) References Cited

U.S. PATENT DOCUMENTS 6,971,688 B2 * 12/2005 Drysdale ..... E05B 77/06 292/216
2010/0237633 A1 9/2010 Jankowski et al.
(Continued)

FOREIGN PATENT DOCUMENTS

DE 102011010816 A1 8/2012
EP 1518983 A2 3/2005

OTHER PUBLICATIONS

Machine Translation of EP1518983A2 by Lexis Nexis Total Patent dated Oct. 1, 2015.

*Primary Examiner* — Alyson M Merlino
(74) *Attorney, Agent, or Firm* — Woodard, Emhardt, Moriarty, McNett & Henry LLP

(57) ABSTRACT

The invention relates to a lock, in particular for a door or opening element of a motor vehicle, said lock comprising a locking mechanism with a rotary latch, a pawl for locking the rotary latch in a detent position, preferably a blocking lever for blocking the pawl in the detent position and a release lever for opening the locking mechanism, in particular by moving the blocking lever out of the blocking position. The lock is characterized in that a safety catch device of the lock, said device comprising in particular more than one catch position, is designed to prevent the opening of the locking mechanism during excessive acceleration, in particular during excessively violent acceleration of the release lever and/or handle of a door or opening element. An unplanned opening of the lock in the event of a crash can thus be avoided.

16 Claims, 4 Drawing Sheets

(51) Int. Cl.

| | |
|---|---|
| ***E05B 77/06*** | (2014.01) |
| ***E05B 85/24*** | (2014.01) |
| ***E05C 3/12*** | (2006.01) |
| ***E05C 19/00*** | (2006.01) |
| ***E05C 19/02*** | (2006.01) |

(58) Field of Classification Search
CPC ..... Y10T 292/1046; Y10S 292/22; Y10S 292/23; Y10S 292/65; E05B 77/02; E05B 77/04; E05B 77/06; E05B 77/54; E05B 85/243; E05B 85/26
See application file for complete search history.

(56) References Cited

U.S. PATENT DOCUMENTS

| | | | | |
|---|---|---|---|---|
| 2013/0313036 | A1* | 11/2013 | Kovie | E05B 77/06 180/274 |
| 2014/0035295 | A1 | 2/2014 | Bendel et al. | |
| 2014/0132008 | A1* | 5/2014 | Bendel | E05B 85/26 292/92 |
| 2014/0203575 | A1* | 7/2014 | Brickner | E05B 77/12 292/341.17 |
| 2015/0315824 | A1* | 11/2015 | Gotzen | E05B 77/06 292/200 |

* cited by examiner

LOCK FOR A MOTOR VEHICLE

CROSS-REFERENCE TO RELATED APPLICATIONS

This application is the U.S. national stage application of International Patent Application No. PCT/DE2014/000055, filed Feb. 14, 2014, which claims priority of German Application No. 10 2013 203 808.9, filed Mar. 6, 2013, which are both hereby incorporated by reference.

BACKGROUND

The invention relates to a latch for a motor vehicle.

A latch for a motor vehicle comprises a locking mechanism with a rotatably mounted catch accommodating a locking bolt, also referred to as latch holder. The locking mechanism also contains a pawl that can engage the catch in order to retain the locking bolt.

The catch of a motor vehicle latch usually contains a fork-like inlet slot (also referred to as inlet section) formed by a load arm and a collecting arm, which is entered by a locking bolt of a motor vehicle door or flap, such as a bonnet or boot lid when the door or flap is shut. The locking bolt or the latch holder then turns the catch from an opening position to a closed position until the pawl locks the catch. This position is referred to a detent position. The locking bolt can then no longer leave the inlet slot of the catch.

A latch can also contain a lock lever that can block the pawl in its detent position. The lock lever must be pivoted or turned out of its locking position so that the pawl can leave its detent position for opening the locking mechanism.

Latches exist in which the catch can introduce an opening moment into the pawl, if it is in its detent position. A lock lever is required for such a latch in order to lock the locking mechanism into place. Such latches can be opened with little force.

Motor vehicle latches exist, that feature two detent positions, a pre-ratchet position and a main ratchet position. The pre-ratchet position serves to retain the door or flap if it has not reached the main ratchet position during closing. If the catch is turned further starting from the pre-ratchet position, it eventually reaches the main ratchet position.

A latch generally contains a release lever required to open a locking mechanism and to release it. Such a release lever is typically connected to the handle of a door or of a flap. Upon actuation of the handle, the release lever is actuated and pivoted in order to release the locking mechanism and thus open the latch.

In the event of a crash, the handle can be accidentally activated, causing the locking mechanism to be opened. It should be ensured that such a latch can not accidentally open in such a situation.

In order to ensure that a latch cannot accidentally open in the event of a crash, printed matter EP 1518983A2 provides a latch with a locking mechanism, containing at least one actuating lever for triggering or opening the locking mechanisms, i.e. a release lever. The latch also contains a lock lever locking the actuating lever in case of a specified acceleration of the vehicle.

During a crash, particularly high accelerations are generated compared to the usual opening. If the lock lever blocks only during high vehicle accelerations, as experienced in the event of a crash, unintentional opening of the locking mechanisms in the event of a crash can be prevented. In case of a usual actuation of the door handle, the actuating lever is not blocked as no high acceleration is applied, allowing opening of the latch.

In the event of a crash, a rebound effect also referred to as bouncing can follow the excessive acceleration forces experienced during a crash. A delayed or repeated bouncing, in particularly coupled with changing acceleration forces and directions can cause a failure of the locking device during high acceleration, aiming to prevent accidental opening of the latch in the event of a crash.

SUMMARY

The object of the invention is to provide a latch in which accidental opening is avoided in the event of a crash.

In order to solve this task, a latch with a locking mechanism is provided that contains a catch and a pawl for locking the catch. The latch preferably also contains a lock lever, able to block the pawl if it is in its detent position. The arrangement also contains a release lever for opening or triggering the locking mechanism.

Optionally, the lock can contain a pre-ratchet pawl which generally can be identical or form a single piece with the release lever.

If the release lever is activated, this moves the lock lever out of its locking position if not exposed to any excessive acceleration. The excessively high acceleration preferably relates to the release lever of the latch. The latch can, however, also be designed in such a way that an excessive acceleration of the handle of an associated door or flap is decisive and that, depending on this acceleration, the locking device allows or prevents opening.

In one embodiment, the release lever can directly move the pawl out of its detent position. This embodiment generally does not contain a lock lever for locking a pawl.

In case of excessive acceleration of, for instance, the release lever, caused for instance by a crash, the locking device of the latch prevents accidental opening of the latch. In particular, a locking device prevents the release lever from moving a lock lever of the latch—able to block a locking pawl in its detent position—out of its locking position. The latch can consequently not open, if for instance the release lever and/or an associated handle of a door or flap are subjected to a respectively strong acceleration in the event of a crash.

In one embodiment of the invention, the locking device contains at least two locking positions. If the locking device is in a first locking position, for instance due to an excessive high acceleration of the release lever, caused in particular by an impact as a result of a crash and where the locking device is released from the first locking position, for instance, due to a bounce back and, in particular, due to a delayed and/or repeated bounce back, the locking device can also prevent the locking mechanism from opening, i.e. that the release lever moves the lock lever out of its locking position in one embodiment, by assuming a second or further locking position. By providing a locking device with at least two locking positions, accidental opening of the latch can be prevented even in case of the occurrence of bounce back effects.

In one embodiment, the locking device contains an inertia lever and a lock lever. The inertia lever and the lock lever are connected in such a way that the inertia lever is only moved together with the lock lever by actuating the release lever or actuating a handle of a door or flap if the release lever is accelerated in the usual manner, as experienced during a usual actuation of the door handle, i.e. it is not exposed to an excessive acceleration. In this case, the inertia lever and lock lever are moved together in such a way that the lock lever cannot prevent opening of the locking mechanism. Where a handle of a door or of a flap is actuated by a user of the vehicle, a handle and a release lever connected thereto are generally not excessively accelerated.

In one embodiment of the invention, the inertia lever and the lock lever are connected to each other in such a way, that if the release lever or the handle of a door or flap are subjected to high accelerations, as is possible during a crash, only the lock lever is moved due to the inertia of the inertia lever and into one of the locking positions of the locking device, locking further pivoting of the release lever or of the handle in such a way that opening of the locking mechanism is prevented.

In one embodiment of the invention, the locking device contains a spring, connecting the inertia lever and the lock lever in such a way that the inertia lever can only be moved together with the lock lever by actuating the release lever or by actuating the handle, when the release lever or the handle are accelerated in the usual manner. This technically simple arrangement thus prevents accidental opening of a latch in the event of a crash.

One leg of the spring is connected to the inertia lever in one embodiment of the invention. Such a connection exists, in particular, when the preferably pretensioned leg of the spring rests against the contour of the inertia lever.

Another leg of the spring is connected to the lock lever. Such a connection exists, in particular, when the preferably pretensioned leg of the spring rests against the contour of the lock lever. In case of lower accelerations, the spring acts like a rigid connection between the lock lever and the inertia lever. In case of lower accelerations, the lock lever and inertia lever are thus jointly moved by actuating the release lever or handle for opening of the locking mechanism.

In case of a high acceleration, the inertia of the inertia lever deforms the spring in such a way that only the lock lever is moved but not the inertia lever. The spring is, in particular, tensioned further in case of a high acceleration. If the lock lever is moved independently from the inertia lever, the lock lever then enters its locking position. In the locking position, the release lever or handle is prevented from being turned further which could cause an opening of the locking mechanism.

In one embodiment, the lock lever contains a tappet that can be moved by the release lever for moving the lock lever. Actuation of the release lever moves the tappet and thus the lock lever.

In one embodiment, the tappet of the lock lever extends through a slotted hole of the inertia levers in order to permit a relative movement between the lock lever and the inertia lever.

In one embodiment, the mass of the inertia lever is several times greater than the mass of the lock lever, in order to reliable achieve that the inertia lever is only moved during a slight acceleration of the release lever. Preferably, the mass of the inertia lever is twice, preferably three times and even more preferably even four times greater than the mass of the lock lever.

In one embodiment, the latch contains a lock contour, preferably rigidly connected to a latch case of the latch. The latch contour serves to block the lock lever when the release lever and/or handle are subjected to excessive acceleration. If the lock lever is blocked by the lock contour and is thus in a locking position, the release lever or handle cannot be pivoted further in such a way that the locking mechanism is opened.

In one embodiment, the lock contour abuts against the internal wall of the latch case, in order to transfer the impact forces onto the latch case when the lock lever rests against the lock contour. The lock contour can thus have a small design.

In one embodiment, the lock lever is connected to the inertia lever in such a way that a projection of the lock lever adjoins the external contour of the inertia lever if the acceleration of the release lever or handle is not excessively high and abuts, in particular, the section of the external contour of the inertia lever, which during pivoting of the locking mechanism, still locked in a detent position, is facing the lock contour and/or is a maximum distance away from the axis of the inertia lever. As a result of the small distance between the lock lever and the lock contour when the locking mechanism is locked, the locking mechanism can be particularly quickly blocked by the locking device in the event of a crash and a bounce back.

In one embodiment, the lock contour contains an arc, whose centre point corresponds to the axis of the inertia lever. Preferably, the radius of the arc is a slit wider than the maximum distance of the external contour of the inertia lever of its axis. The small distance between the lock lever and lock contour when the locking mechanism is locked, can cause a particularly fast locking of the locking mechanism by a locking device in case of a crash and bounce back.

In one embodiment, the lock lever contains a projection at one end, pointing outwards in radial direction and in relation to the axis of the inertia lever. Where the lock lever is moved in relation to the inertia lever due to an excessive acceleration of the release lever and/or handle, the projection points in the direction of the lock contour or faces the lock contour, ensuring that the lock lever is held securely in a locking position in the lock contour. This contributes to providing a variety of locking positions in a technically simple manner.

In one embodiment, the lock contour contains a stop and/or at least one recess for locking the lock lever, if the release lever and/or handle are subjected to excessive acceleration. The recess or recesses are preferably arranged in circumferential direction of the inertia lever in counter-clockwise direction. A locking position of the locking device of the lock lever can thus be specified by the stop, the recess or recesses. Material can, in particular be saved if first a stop and then a recess is provided.

Specifying a locking position by, for instance, a stop or a recess means that a locking position is taken up by the locking device when the stop or recess can prevent accidental opening of the latch by stopping or locking the lock lever.

In particular in case of bounce back effects it can occur that the lock lever is accidentally released from the locking position on the stop of the lock contour. The inertia lever can then move in counter-clockwise direction and cause the locking mechanism to accidentally open. A recess preferably arranged counter-clockwise in the direction of the circumference of the inertia lever allows a locking or locking of the lock lever again, thus preventing accidental opening of the locking mechanism also in case of bounce back effects.

In one embodiment, a recess of the lock contour is triangular. The triangular shape of a recess results in a self-centering when the projection of the lock lever engages in the recess and offers a particularly high reliability of the locking device.

In one embodiment, the lock lever contains a triangular projection with slanting surface on both sides, with the slanting surface arranged in counter-clockwise direction, having less of an incline than the other opposing slanting surface arranged in clockwise direction around the axis of the lock lever. The different inclines of the slanted surfaces of the projection provide a particularly reliable retention of the locking device or of the projection of the lock lever in the locking positions.

In one embodiment, one recess of the lock contour is adapted to the projection of the lock lever in the locking position, determined by the recess. This adaptation is located, in particular, in the area of the overlap. Preferably, such an adaptation includes the inclines of the slanting surfaces of the projection of the lock lever. The adaptation of the contour of the recess of the lock contour to the contour of the projection of the lock lever in the area of the overlap provides a particularly secure hold against pivoting on either side and prevents accidental detachment of the locking device and a potential damage of the locking mechanism.

In one embodiment, the stop contains an inclined surface of the lock contour, essentially parallel to the inclination of the projection of the lock lever in the locking position, which can come into contact with the stop during locking of the locking mechanism by the locking device. As a result of the essentially parallel inclined surfaces, the stop and the project can be reduced in size as a result of the full-area load absorption.

In one embodiment, the axis of the lock lever is arranged at the end of the lock levers opposing the projection. The arrangement of the axis at preferably the greatest distance to the projection provides a particularly large pivot path of the projection of the lock lever during activation of the lever arm of the release lever and due to the thus achieved overlap of the projection in the lock contour and a particularly reliably retention of the locking device in the locking position.

Below, the invention is explained in detail with reference to FIGS. 1 to 4.

DETAILED DESCRIPTION OF THE DRAWINGS

Figure 1:
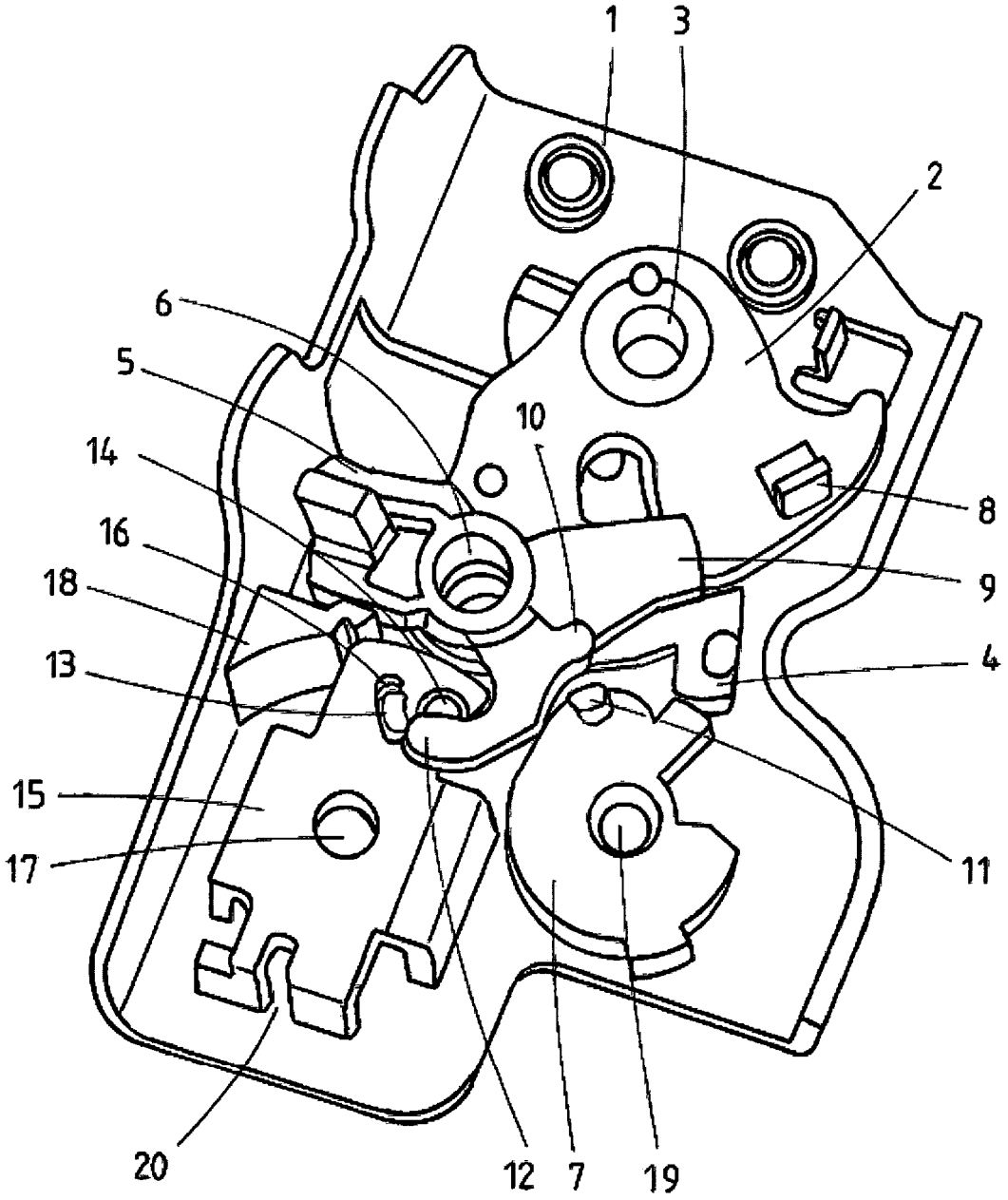
FIG. 1 is a perspective view of a locking mechanism an a portion of a latch case.

FIG. 1 shows a latch case 1 of a latch made, in particular, of metal, serving to house a locking mechanism. The locking mechanism contains a rotatably mounted catch 2, preferably essentially made of metal and that can be rotated around its axis 3. The locking mechanism also contains a main ratchet pawl 4 preferably essentially made of metal and a pre-ratchet pawl 5 also preferably essentially made of metal.

The main ratchet pawl 4 and the pre-ratchet pawl 5 are arranged above each other and contain a common axis of rotation 6, allowing both pawls 4 and 5 to be pivoted independent from one another. The locking mechanism also contains a lock lever 7 that can block the main ratchet pawl 4 in the shown locked position of the locking mechanism as shown in FIG. 1. The catch 2, the main ratchet pawl 4 and the lock lever 7 are essentially located on the same plane. A higher plane contains the pre-ratchet pawl 5. In FIG. 1 a considerable part of the main ratchet pawl 4 is covered by the pre-ratchet pawl 5, in particular, the part of the main ratchet pawl 4, locking the catch 2.

In order to be able to lock the catch 2 in the pre-ratchet position, the catch 2 contains a protruding pin 8 that can be moved against the lever arm 9 of the pre-ratchet pawl 5 for locking in the pre-ratchet position. The end of the lever arm 9 then prevents clockwise pivoting of the catch 2 in the direction of its open position.

The catch 2 can introduce an opening moment into the main ratchet pawl 4. When the lock lever 7 leaves it locking position, the main ratchet pawl 4 moves out of its detent position due to the introduced opening moment. The catch 2 can then be moved into its open position by clockwise turning around its axis 3.

The pre-ratchet pawl 5 is also the release lever of the latch. If the release lever 5 is turned in clockwise direction and is thus activated, a projection 10 of the pre-ratchet pawl 5 engages with a tappet 11 of the lock lever 7, thus turning the lock lever 7 out of its locking position, if the pre-ratchet pawl 5 or the release lever 5 is not excessively accelerated.

If the release lever 5 is turned in clockwise direction for opening the locking mechanism, the end of a lever arm 12 of the release lever 5 moves a tappet 13 of a lock lever 21 hidden in FIG. 1 of a locking device. The lock lever 21 is rotatably connected to an inertia lever 15 by an axis 14. The lock lever 21 is arranged below the inertia lever 15. The tappet 13 extends through a slotted hole 16 of the inertia lever 15 and is engaged by the lever arm 12 of the release lever 5.

In case of an excessive acceleration of the release lever 5, the lock lever 21 is pivoted around its axis 14 in clockwise direction, whilst the inertia lever 15 is not pivoted around its axis 17. This is, amongst other things, made possible as the tappet 13 of the lock lever 21 extends through the slotted hole 16, allowing a relative movement between the lock lever 21 and the inertia lever 15.

During excessive acceleration, one end of the lock lever 21 is moved into one of the locking position (25, 26, 27), provided by the lock contour 18 rigidly connected to the latch case 1. This prevents the release lever 5 from being pivoted further in clockwise direction for pivoting the lock lever 7 out of its locking position. This prevents the lock lever 7 from moving out of its locking position for opening the locking mechanisms by pivoting the lock lever 7 around its axis 19.

The lock contour 18 includes a stop 25 and the recesses 26 and 27, determining the locking positions (25, 26, 27) of the locking device or of the lock lever 21. The lock lever 21 contains a triangular projection 28 with inclined surfaces on both sides, with the inclined surface 29 arranged in clockwise direction containing less of a slope than the other facing slope of the projection arranged in clockwise direction around the axis 14.

The stop 25 is designed as a slope of the lock contour 18 essentially arranged parallel to the slope 29 of the projection 28 of the lock lever 21 in locking direction. During locking of the locking mechanism by the locking device, the slope 29 can come into contact with the stop 25.

The recesses 26 and 27 are triangular with the contour of the recesses (26 or 27) being adapted to the projection 28 of the lock lever 21 in the respective position by the respective recess (26 or 27).

At its bottom end, the inertia lever 15 contains a slit 20, allowing connection to a leg 22 of a spring 23. The leg 22 of the spring 23 then extends into this slit 20.

Figure 2:
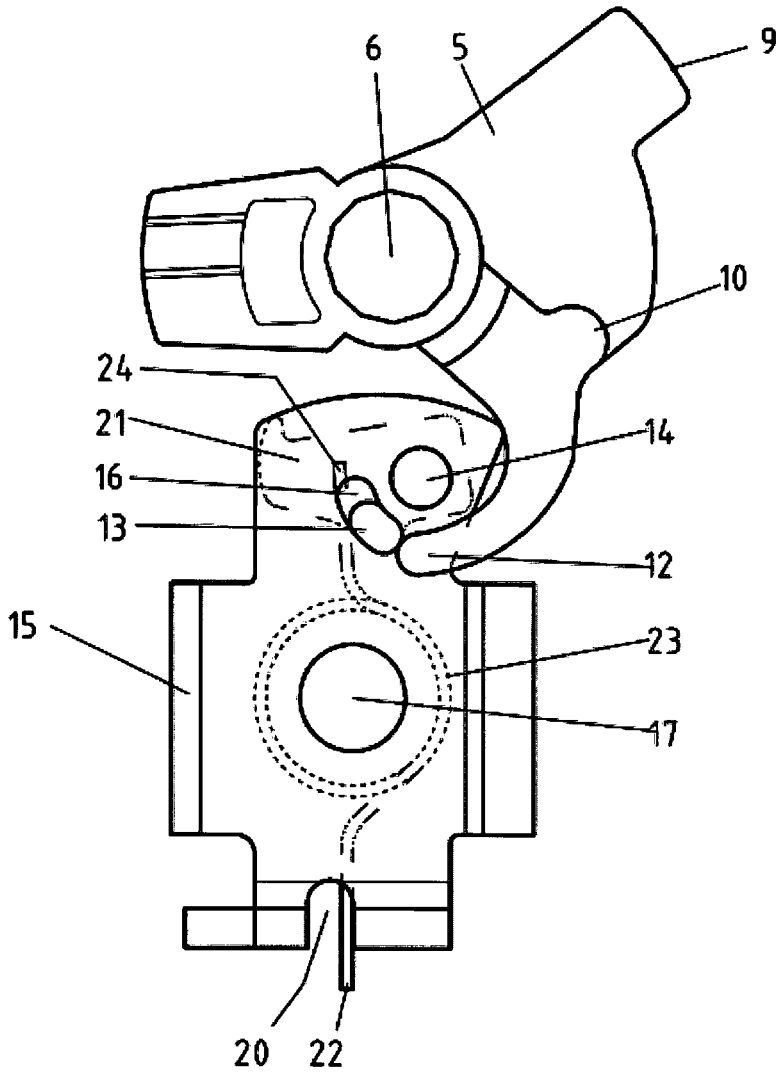
FIG. 2 is a top plan view of the locking mechanism showing the starting position of the locking mechanism being locked.
Figure 3:
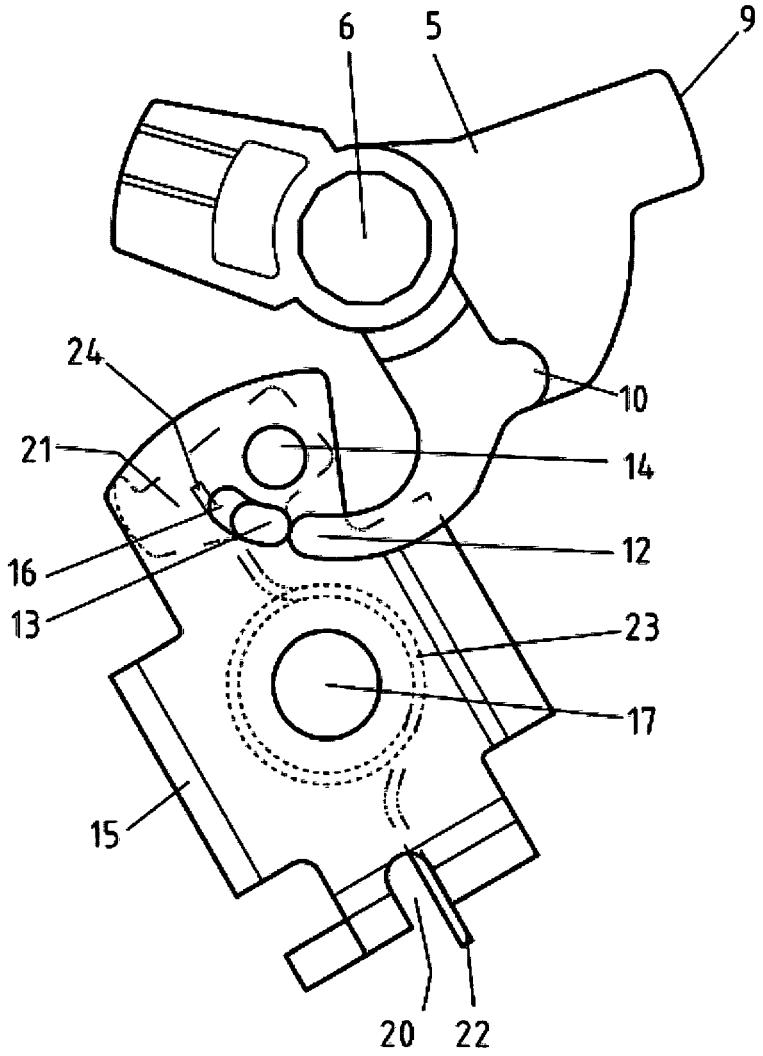
FIG. 3 is a top plan view of the locking mechanism showing a different position of the locking mechanism.

FIGS. 2 and 3 show the design and function of the locking device in the event of a usual opening of the latch.

FIG. 2 shows the starting situation with the locking mechanism being locked. The lock lever 21 is arranged below the inertia lever 15. One leg 22 of the pretensioned spring 23 is located in the slit 20 and is thus connected to the inertia lever 15. The spring 23 is also located below the inertia lever 15 and winds around the axis 17. Axis 17 contributes to holding the spring 23. The other leg 24 of the spring 23 is connected to the lock lever 21. Preferably, the pretensioned leg 24 rests against a lateral contour, for instance against a projection of the lock lever 21, extending downwards.

Figure 4:
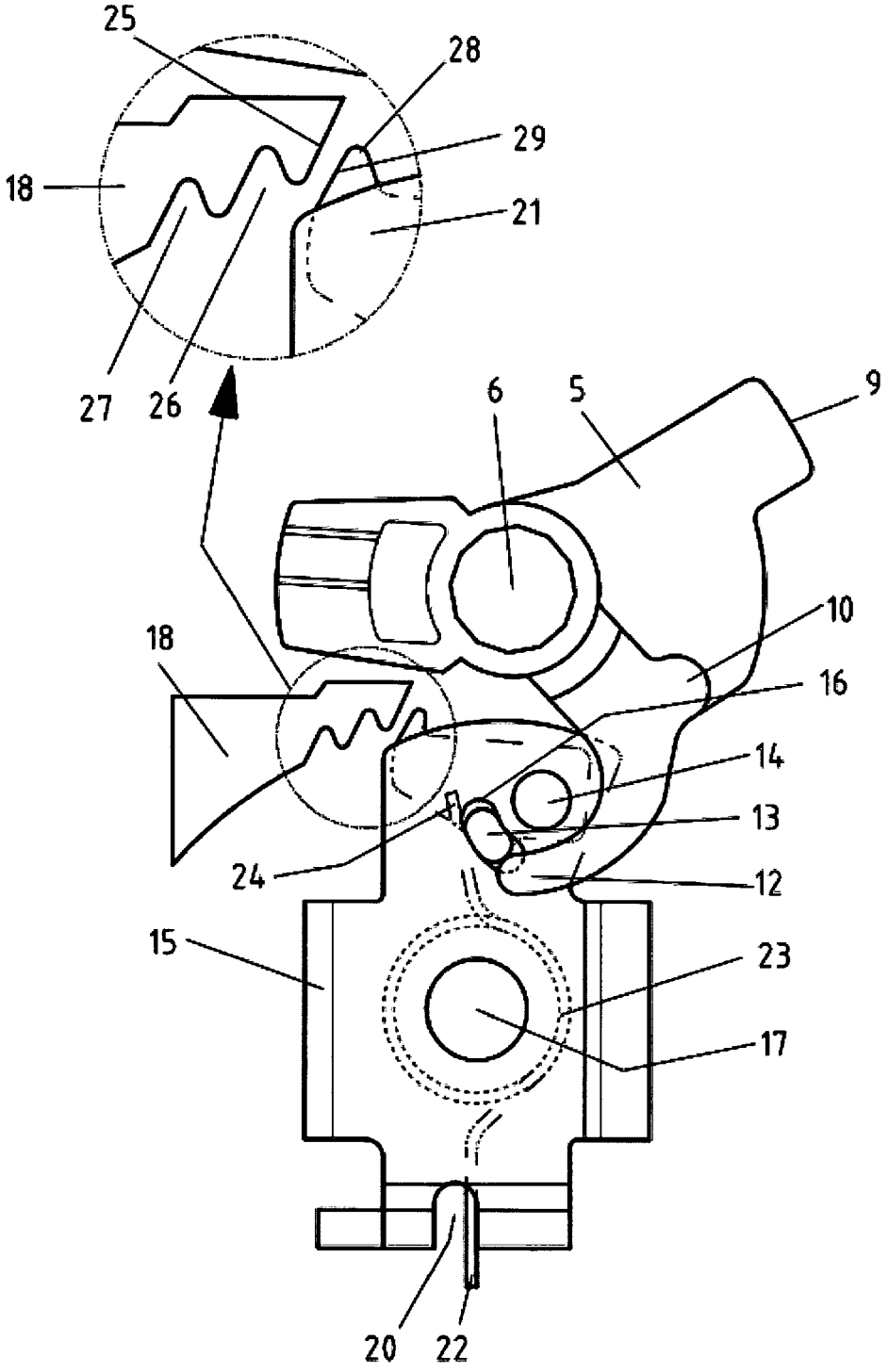
FIG. 4 is a top plan view of the locking mechanism showing the configuration when the release lever is subjected to excessive acceleration.

When the release lever 5 is pivoted around its axis 6 in clockwise direction for opening the locking mechanism whilst not being excessively accelerated, the spring 23 acts like a rigid connection between the lock lever 21 and the inertia lever 15. Pivoting of the release lever 5 in clockwise direction causes the tappet 13 of the lock lever 21 to be moved to the left. As a result, the inertia lever 15 together with the lock lever 21 pivots around its axis 17 in counter-clockwise direction. The lock lever 21 does in this case not assume any of the locking positions (25, 26, 27). The lock lever 7 can be moved out of its locking position by pivoting the release lever 5 in clockwise direction. The locking mechanism then opens. FIG. 4 shows the scenario in which the release lever 5 is subjected to excessive acceleration starting from the situation shown in FIG. 2. Due to the comparatively great mass of the inertia lever 15 compared to the lock lever 21, the inertia lever 15 is no longer pivoted around its axis 17 in counter-clockwise direction. Instead, the leg 24 is deflected. The lock lever 21 is now pivoted around its axis 14 in clockwise direction and moved into its locking position 25, shown in FIG. 4.

The locking position 25 has been reached when the end 28 of the lock lever 21 overlaps the stop 25 so that the inertia lever 15 cannot be pivoted in counter-clockwise direction. The locking position 25 has thus also been assumed when the end 28 of the lock lever 21 overlaps the stop 25 but is not in contact with it, as shown in FIG. 4. The lock contour 18 now prevents the release lever 5 from being pivoted clockwise around its axis 6 in such a way that the lock lever 7 is moved out of its locking position.

In the event of a bounce back it can happen that the lock lever 21 is accidentally released from its locking position 25 at the stop 25 of the lock contour 18. The inertia lever 15 could then move in counter-clockwise direction, causing the release lever 5 to accidentally open the locking mechanism. The recesses 26 and 27, arranged counter-clockwise in the direction of the circumference of the inertia lever 15, now make it possible to block the inertia lever by receiving and locking the lock lever 21, thus preventing accidental opening of the locking mechanism.

The invention claimed is:

1. A latch, for a door or flap of a motor vehicle said latch comprising a locking mechanism comprising a catch and a pawl for locking the catch when in a detent position, a lock lever for locking the pawl in its detent position when in a locking position, a release lever for opening the locking mechanism by moving the lock lever out of its locking position, and a lock contour rigidly connected to a latch case of the latch, wherein the lock contour defines a stop and a plurality of recesses that define a plurality of locking positions of the lock lever, wherein the lock contour is designed in such a way that during excessive acceleration of the release lever and/or in case of excessive acceleration of the release lever via an associated handle of a door or flap, the lock contour locks the lock lever in one of the locking positions, thereby preventing the locking mechanism from being placed in an open state.

2. The latch according to claim 1, further comprising an inertia lever and the lock lever connected to each other in such a way that when the release lever is not excessively accelerated and/or when the release lever is not excessively accelerated via the handle, the inertia lever can move together with the lock lever in order to allow the pawl to move out of its detent position and/or to move the lock lever out of its locking position.

3. The latch according to claim 2, wherein the inertia lever and the lock lever are connected in such a way that the release lever via the handle and/or release lever, when subjected to an excessive acceleration, can only move the lock lever into one of the locking positions of the lock lever, preventing further pivoting of the handle and/or of the release lever to place the locking mechanism in the open state.

4. The latch according to claim 3, further comprising a spring connecting the inertia lever and the lock lever in such a way that only the release lever and/or the release lever via the handle when not excessively accelerated, can move the inertia lever together with the lock lever.

5. The latch according to claim 4, wherein a leg of the spring is connected to the inertia lever and rests, pretensioned, against a contour of the inertia lever and/or another leg of the spring is connected to the lock lever and rests, pretensioned, against a contour of the lock lever.

6. The latch according to claim 4, wherein the lock lever contains a tappet that can be moved by the release lever for moving the lock lever, with a pretensioned leg of the spring resting against the tappet.

7. The latch according to claim 6, wherein the inertia lever has a slotted hole designed in such a way that the tappet of the lock lever extends through the slotted hole of the inertia lever and/or facilitates a relative movement between the lock lever and the inertia lever.

8. The latch according to claim 2, wherein the mass of the inertia lever is several times larger than the mass of the lock lever.

9. The latch according to claim 1, wherein the lock lever contains one end with a projection which, when the release lever is excessively accelerated and/or is excessively accelerated via the handle, faces the lock contour and is adapted to cooperate with the lock contour.

10. The latch according to claim 1, wherein the plurality of recesses are arranged clockwise in a direction of the circumference of the inertia lever as seen from the stop.

11. The latch according to claim 1, wherein each of the plurality of recesses of the lock contour is triangular.

12. The latch according to claim 10, wherein a projection of the lock lever is triangular with slopes on sides thereof and in which one of the slopes is arranged counter-clockwise to an axis of the lock lever has less of an inclination than the other one of the slopes of the projection.

13. The latch according to claim 12, wherein the stop contains a slope, which is essentially parallel to one of the slopes of the projection of the lock lever when the lock lever is in one of the locking positions, the one of the slopes of the projection can come into contact with the stop during the locking of the lock lever.

14. The latch according to claim 12, wherein an axis of the lock lever is arranged at a first end of the lock lever opposite a second end of the lock lever having the projection.

15. The latch according to claim 2, wherein the mass of the inertia lever is at least twice as large as the mass of the lock lever.

16. A latch, for a door or flap of a motor vehicle said latch comprising a locking mechanism comprising a catch and a pawl for locking the catch when in a detent position, a lock lever for locking the pawl in its detent position when in a locking position, a release lever for opening the locking mechanism by moving the lock lever out of its locking position, and a lock contour rigidly connected to a latch case of the latch, wherein the lock lever contains a tappet that can be moved by the release lever for moving the lock lever, with a pretensioned leg of a spring resting against the tappet, wherein the inertia lever has a slotted hole designed in such a way that the tappet of the lock lever extends through the slotted hole of the inertia lever and/or facilitates a relative movement between the lock lever and the inertia lever, wherein the lock contour is designed in such a way that during excessive acceleration of the release lever and/or in case of excessive acceleration of the release lever via an associated handle of a door or flap, the lock contour locks the lock lever in a locking position, thereby preventing the locking mechanism from being placed in an open state.

* * * * *